US009777563B2

(12) United States Patent
Balczewski

(10) Patent No.: US 9,777,563 B2
(45) Date of Patent: Oct. 3, 2017

(54) NATURAL GAS HYDRATE RESERVOIR HEATING

(71) Applicant: Chevron U.S.A. Inc., San Ramon, CA (US)

(72) Inventor: John T. Balczewski, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/485,275

(22) Filed: Sep. 12, 2014

(65) Prior Publication Data

US 2015/0090455 A1 Apr. 2, 2015

Related U.S. Application Data

(60) Provisional application No. 61/884,738, filed on Sep. 30, 2013.

(51) Int. Cl.
*E21B 43/24* (2006.01)
*E21B 43/01* (2006.01)

(52) U.S. Cl.
CPC ..... *E21B 43/24* (2013.01); *E21B 2043/0115* (2013.01)

(58) Field of Classification Search
CPC ..... C09K 8/68; E21B 29/00; E21B 29/02
See application file for complete search history.

(56) References Cited

U.S. PATENT DOCUMENTS 3,338,306 A 8/1967 Cook
3,986,557 A 10/1976 Striegler et al.
3,994,340 A 11/1976 Anderson et al.
4,007,788 A 2/1977 Striegler et al.
4,344,485 A 8/1982 Butler
2004/0200618 A1* 10/2004 Piekenbrock ..... E21B 41/0057 166/305.1
2005/0103498 A1* 5/2005 Yemington ..... E21B 17/18 166/302
2007/0114026 A1 5/2007 La Rovere et al.
2010/0048963 A1* 2/2010 Jones ..... E21B 43/34 585/15
2010/0163231 A1 7/2010 Balczewski
(Continued)

FOREIGN PATENT DOCUMENTS

CA 2675160 2/2010
CA 2675160 C 11/2011
NO WO 2013056732 A1 * 4/2013 ..... C10G 2/00
(Continued)

OTHER PUBLICATIONS

R. R. Ibatullin et al., "A Novel Thermal Technology of Formation Treatment Involves Bi-Wellhead Horizontal Wells", SPE 120413, SPE International, pp. 1-5 (2009).
(Continued)

*Primary Examiner* — Zakiya W Bates

(57) ABSTRACT

A heating system for heating a natural gas hydrate reservoir. The heating system includes a fully enclosed wellbore extending through a portion of the natural gas hydrate reservoir. A heating fluid is passed through the wellbore to heat the portion of the natural gas hydrate reservoir. Additionally, a production system includes a perforated wellbore that is used to extract the natural gas hydrate water after heating.

35 Claims, 7 Drawing Sheets

(56) References Cited

U.S. PATENT DOCUMENTS

2010/0200223 A1 8/2010 Mauduit et al.

FOREIGN PATENT DOCUMENTS

| | | |
|---|---|---|
| RU | 2095549 | 11/1997 |
| RU | 2305762 | 9/2007 |

OTHER PUBLICATIONS

Bybee, et al., "Novel Thermal Technology Uses Two-Wellhead Wells", Journal of Petroleum Technology, Mar. 2010, p. 63-64.
Ibatullin et al., SPE 120413 "A Novel Thermal Technology of Formation Treatment Involves Bi-Wellhead Horizontal Wells", Society of Petroleum Engineers, 2009, 5 pages.
International Search Report from corresponding PCT Application No. PCT/US2014/055352 dated Jul. 21, 2015.

* cited by examiner

NATURAL GAS HYDRATE RESERVOIR HEATING

This application claims priority to U.S. Provisional Application Ser. No. 61/884,738, filed Sep. 30, 2013, the contents of which is herein incorporated by reference in its entirety.

BACKGROUND

Natural gas hydrate is a crystalline solid formed of gas molecules and water molecules. The ice-like solid traps the gas molecules within a cage formed by the water molecules. Natural gas hydrate is also sometimes known by other names, such as gas hydrate, gas clathrate, methane clathrate, methane hydrate, hydromethane, methane ice, and fire ice, which are all referred to herein as natural gas hydrate.

Deposits of natural gas hydrate have been found in reservoirs located under sediments on the ocean floors of the Earth. Because the natural gas hydrate is in a solid form, it cannot be easily removed from the reservoir in this state. However, if the natural gas hydrate is heated, the state of the water molecules can be changed resulting in the release of the gas molecules in a process known as dissociation. Dissociation is an endothermic process, which means that the rate of dissociation is controlled by the amount of heat available in the surrounding environment.

One technique for producing natural gas hydrate from a reservoir is to inject deeper aquifer water into the reservoir to heat the natural gas hydrate. There are several drawbacks with this technique. One drawback is that the injection of the water increases the pressure in the reservoir, thereby reducing the production rate. To avoid the increase in pressure, the natural gas hydrate water as well as the deeper aquifer water can be reduced, which greatly increases the capital and operating costs. Furthermore, the deeper aquifer water may come out of solution when injected into the natural gas hydrate reservoir, causing salts and other materials to precipitate out, which can result in blocking the reservoir, or the injecting or producing wells.

SUMMARY

In general terms, this disclosure is directed to heating an underground reservoir. In one possible configuration and by non-limiting example, the a fully enclosed wellbore is formed through an underground reservoir that contains natural gas hydrate. A fluid is passed through the wellbore to heat the natural gas hydrate. Various aspects are described in this disclosure, which include, but are not limited to, the following aspects.

One aspect is a method of heating natural gas hydrate, the method comprising: forming a fully enclosed well through a portion of a natural gas hydrate reservoir, the reservoir containing natural gas hydrate; and passing a heating fluid through the well to heat the natural gas hydrate in the portion of the natural gas hydrate reservoir.

Another aspect is a method of producing natural gas hydrate from a natural gas hydrate reservoir, the method comprising: heating a portion of the natural gas hydrate reservoir by passing a heating fluid through a non-perforated wellbore; perforating the wellbore after heating the portion of the natural gas hydrate reservoir; and extracting natural gas hydrate water from the natural gas hydrate reservoir through the wellbore.

A further aspect is a fully enclosed wellbore extending through a portion of a natural gas hydrate reservoir.

Yet another aspect is a heating system comprising: a fully enclosed wellbore extending through a portion of a natural gas hydrate reservoir, the wellbore including a first end and a second end; and a fluid pump configured to pump a heating fluid through the wellbore to heat the portion of the natural gas hydrate reservoir.

DETAILED DESCRIPTION

Figure 1:
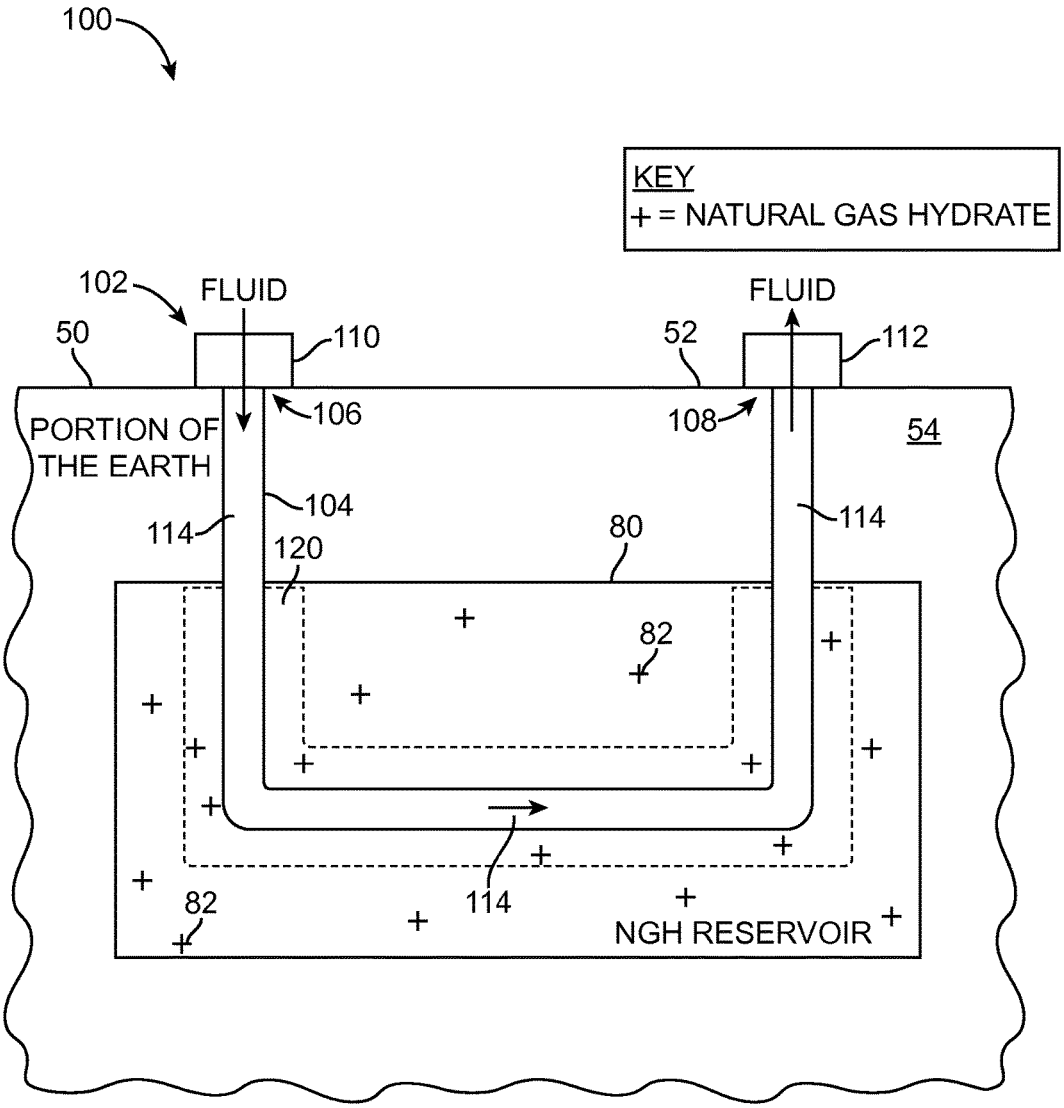
FIG. 1 is a schematic block diagram illustrating a portion of the earth including a natural gas hydrate reservoir, and further illustrating an example heating system for heating the natural gas hydrate reservoir.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Introduction

If proponents of Hubbert peak theory are correct, world oil production will at some point peak, if it has not done so already. Regardless, world energy consumption continues to rise at a rate that outpaces new oil discoveries. As a result, alternative sources of energy must be developed, as well as new technologies for maximizing the production and efficient consumption of oil.

In maximizing the production of oil, deepwater and permafrost drilling are being developed because they allow for production of oil and gas in reservoirs that have previously been inaccessible. Deepwater drilling is the process of oil and gas exploration and production in depths of more than 500 feet. Permafrost drilling is the process of oil and gas exploration and production in areas where seasonal temperatures are cold enough for permafrost to exist. Both had been economically infeasible for many years, but with rising oil prices, more companies are now routinely investing in these areas.

In addition to conventional oil and gas development, attractive alternative sources of energy may be developed. One potentially very large alternative source of energy is marine and permafrost natural gas sequestered in materials called clathrates. A clathrate is a chemical compound in which molecules of one material (the "host") form a solid lattice that encloses molecules of one or more other materials (the "guest(s)"). Clathrates are also called inclusion compounds and important features of clathrates are that not all the lattice cells are required to be filled (i.e. they are non-stoichiometric) and the guest molecule(s) are not chemically bound to the host lattice.

Naturally-occurring clathrates of natural gas form when water 'host' molecules and certain low molecular weight hydrocarbon gas 'guest' molecules are brought together under suitable conditions of relatively high pressure and relatively low temperature. Under these conditions the "host" water molecules will form a cage or lattice structure capturing one or more hydrocarbon "guest" gas molecules inside. Large quantities of hydrocarbon gas are closely packed together by this mechanism. For example a cubic meter of natural gas hydrate contains approximately 0.8 cubic meters of water and generally 164 cubic meters of natural gas at standard temperature and pressure conditions.

Methane is the most common guest molecule in naturally-occurring clathrates of natural gas. Many other low molecular weight gases also form hydrates, including hydrocarbon gases such as ethane and propane and non-hydrocarbon gases such as CO2 and H2S.

Natural gas hydrates form naturally and are widely found at about 200 meters depth below the surface in permafrost areas, potentially within and below the permafrost layer. Natural gas hydrates also are found in sediments along continental margins at water depths generally greater than 500 meters (1600 feet) at mid to low latitudes and greater than 150-200 meters (500-650 feet) at high latitudes. The thickness of the hydrate stability zone varies with temperature, pressure, composition and availability of the hydrate-forming gas, underlying geologic conditions, water depth, salinity, and other factors.

Estimates of the amount of methane sequestered globally in natural gas hydrates have varied widely. The earliest estimates ranged between 100,000 and 100,000,000 trillion cubic feet (TCF). Since the start of dedicated drilling in the mid-1990s researchers learned that the percentage of natural gas hydrates within the pore spaces of marine sediments (referred to as natural gas hydrate saturation) were often far lower than the theoretical maximum saturation. This led to downward revisions of the amount of methane sequestered globally in natural gas hydrates to between 100,000 and 5,000,000 TCF with the most frequently quoted estimate of 700,000 TCF (a number which excludes any hydrates located in Antarctic or alpine permafrost areas). Even the lowest estimate represents an enormous potential new energy resource, equal to more than 4,000 times the amount of natural gas consumed in the US in or 18 times the entire world's proven gas resources.

Recognizing that only a fraction of the globally sequestered methane is likely to be concentrated enough and accessible enough to be produced, and acknowledging that to date there has never been a long-term production test of natural gas hydrates, it is still clear that natural gas hydrates have the potential to become a very large new energy source for the world.

To produce gas from natural gas hydrates the natural gas hydrates must first be converted back ("dissociated") into water (either liquid or ice) and producible free gas molecules by one or any combination of four methods:

Addition of heat until the natural gas hydrate is outside the phase stability envelope Reduction of pressure (depressurization) until the natural gas hydrate is outside the phase stability envelope Addition of a hydrate inhibitor such as a salt, methanol, etc. to shift the phase stability envelope to the point where the natural gas hydrate is outside the phase stability envelope Molecular substitution, where one type of guest molecule is substituted for another Although only a few natural gas hydrate production tests have taken place, all of very limited duration, significant work with reservoir simulators and laboratory experiments have led those experienced in the art to generally believe that depressurization would the most economical form of natural gas hydrate production.

It is also a widely held belief that natural gas hydrate reservoirs could be produced using largely conventional and production technologies.

Regardless of the production method, natural gas hydrate dissociation is an endothermic process, meaning it is a process that is limited by how much thermal energy is available in the vicinity. As the endothermic dissociation process proceeds and draws thermal energy from adjacent sediments, it causes them to cool. A natural consequence of dissociation of cold natural gas hydrates is the potential freezing of adjacent portions of the reservoir. Freezing of adjacent portions of the reservoir would effectively plug the well because of the very long time spans required for the frozen reservoir to naturally thaw. Addition of localized heat to thaw the frozen reservoir would also be a possible solution, but so much heat would need to be applied the economic impact would make this method prohibitive.

Natural gas hydrate reservoirs that are at pressures and/or temperatures well inside the hydrate phase stability zone (i.e. reservoirs that are very cold and/or under very high pressure) will require significant drops in pressure and/or addition of heat to initiate dissociation and will likely have limited ambient thermal energy in the surrounding sediments above and below the natural gas hydrates to support economic rates of gas production. The most desirable natural gas hydrate reservoirs are therefore those that warm and at or near the phase stability envelope. Unfortunately, it is a matter of geologic chance whether a given natural gas reservoir would meet such desirable characteristics.

Most of the natural gas hydrate research to date has focused on basic research, as well as detection and characterization of hydrate reservoirs. Extraction methods that are commercially viable and environmentally acceptable are still at an early developmental stage.

Therefore, technologies must be further developed before these additional sources of hydrocarbons become commercially-viable sources of energy.

FIG. 1 is schematic block diagram illustrating a portion of the earth 50 including a natural gas hydrate reservoir 80, and further illustrating an example heating system 100 for heating the natural gas hydrate reservoir 80.

The portion of the earth 50 includes a surface 52 and a subsurface portion 54. The portion of the earth 50 may include land, or land and sea, for example.

The natural gas hydrate reservoir 80 is located in the subsurface portion 54, and includes natural gas hydrate 82. Typically the natural gas hydrate reservoir 80 is naturally occurring, and is located some distance below the surface 52.

In this example, the heating system 100 includes a well 102 having a wellbore 104. The wellbore 104 can be formed by drilling through the portion of the earth 50, for example. The wellbore 104 typically includes a first end 106 and a second end 108, and defines a passageway between the first end 106 and the second end 108.

In some embodiments, the well 102 also includes well heads. For example, the first end 106 of the wellbore 104 is coupled to a well head 110, and the second end 108 of the wellbore 104 is coupled to the well head 112.

To heat the natural gas hydrate 82 within the natural gas hydrate reservoir 80, a fluid 114 is passed through the well 100. As one example, fluid 114 is pumped into the well head 110 and through the first end 106 of the wellbore 104. The fluid 114 continues through the wellbore 104 and into the natural gas hydrate reservoir 80. The fluid 114 has a temperature that is greater than a temperature of the natural gas hydrate reservoir. Therefore, heat from the fluid 114 is transferred into the natural gas hydrate reservoir, forming a heated portion 120 adjacent the wellbore 104. The fluid 114 proceeds along the wellbore 104 to the second end 108 where the fluid 114 exits the wellbore through the well head 112.

One example of a fluid is seawater. Other embodiments utilize other fluids, such as discussed herein.

Figure 2:
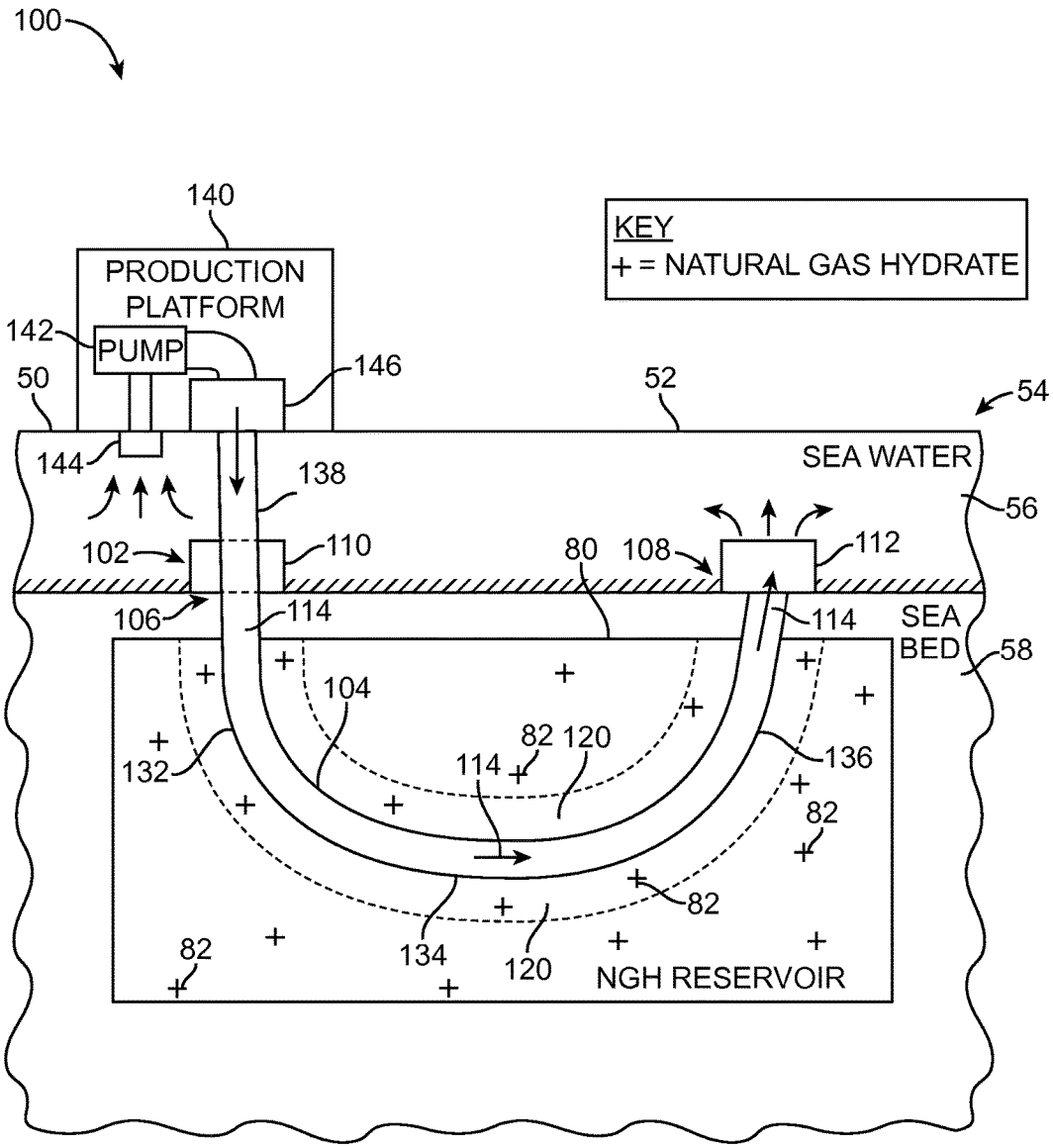
FIG. 2 is a schematic diagram illustrating another portion of the earth including a natural gas hydrate reservoir, and further illustrating another example of the heating system shown in FIG. 1.

FIG. 2 is schematic diagram illustrating another portion of the earth 50 including a natural gas hydrate reservoir 80, and further illustrating another example of the heating system 100 for heating the natural gas hydrate reservoir 80.

The portion of the earth 50 includes a surface 52 and a subsurface portion 54. In this example, the surface 52 is or includes a surface of a body of water, such as a sea, and the subsurface portion 54 includes sea water 56 (which may be fresh or salt water) and sea bed 58.

The natural gas hydrate reservoir 80 is located in the sea bed 58 of the subsurface portion 54, and includes natural gas hydrate 82.

The example heating system 100 includes a well 102 having a wellbore 104. The wellbore 104 is formed by drilling through the portion of the earth 50, for example. The wellbore 104 typically includes a first end 106 and a second end 108, and defines a passageway between the first end 106 and the second end 108.

In some embodiments, the well 102 also includes well heads. For example, the first end 106 of the wellbore 104 is coupled to the well head 110, and the second end 108 of the wellbore 104 is coupled to the well head 112.

In some embodiments, the wellbore 104 is a U-shaped wellbore. As one example, the wellbore 104 includes a vertical segment 132, a horizontal segment 134, and a slanted segment 136. The vertical segment 132 extends substantially vertically downward from the well head 110. The horizontal segment 134 extends horizontally and is coupled to the vertical segment 132. The slanted segment 136 slants back up to the surface of the sea bed 58. Other configurations are used in other embodiments.

Because the natural gas hydrate reservoirs 80 are often much wider than they are deep, use of a horizontal segment 134 allows a much larger portion of the NGH reservoir to be exposed to the wellbore 104 than would be exposed using a straight vertical well.

In some embodiments the well head 110 connected to the vertical segment 132 is a vertical well head, and the well head 112 connected to the slanted segment 136 is a slanted well head.

In some embodiments, the heating system 100 includes or is coupled to a production platform 140. Examples of production platforms 140 include floating and stationary structures. The production platform 140 often includes drilling systems, gas extraction and processing systems, and gas storage containers. A fluid conduit 138 extends between the production platform 140 and the first well head 110.

One example of a heating fluid 114 is surface sea water 56. Sea water 56 located at or near the surface 52 is warmed by the sun, and can have a temperature that is greater than a temperature of the natural gas hydrate reservoir 80.

In this example, the heating system 100 includes a pump 142 that operates to pump the heating fluid 114 into the well 102. To do so, the pump 142 draws in sea water 56 as the heating fluid 114 through an inlet 144 and out through an outlet 146. The outlet 146 is coupled to the conduit 138 which passes the heating fluid 114 through the first well head 110 and into the well 102. The heating fluid 114 passes through the wellbore 104, including the vertical segment 132, the horizontal segment 134, and the slanted segment 136. Once the heating fluid 114 has passed through the wellbore 104, it passes through the second well head 112 where the heating fluid is expelled and returned to the sea.

As the heating fluid 114 passes through the portion of the well 102 within the natural gas hydrate reservoir 80, such as through the horizontal segment 134, heat from the heating fluid 114 is transferred into the natural gas hydrate reservoir 80. After a period of time, a heated portion 120 is formed. In some embodiments, the heated portion 120 has a minimum or average temperature greater than a threshold temperature, which is also greater than the initial temperature of the natural gas hydrate reservoir 80.

As heating occurs, the natural gas hydrate 82 within the heated portion 120 is also heated. As the natural gas hydrate 82 is heated, dissociation occurs during which the natural gas hydrate 82 is changed back into its constituent parts of water and gas molecules. The natural gas hydrate 82 is thus converted from a crystalline solid form into a natural gas hydrate 82 water containing both water and natural gas. The natural gas hydrate 82 water can then be more easily removed from the natural gas hydrate reservoir, such as using a production well (not shown in FIG. 2).

In some embodiments, the well 102 is fully enclosed so that the heating fluid 114 is passed through the natural gas hydrate reservoir 80 without being injected directly into the natural gas hydrate reservoir. One possible benefit of this is that the pressure is not increased. If the heating fluid 114 were alternatively injected into the natural gas hydrate reservoir 80, the injected fluid would increase the pressure within the natural gas hydrate reservoir 80, which may reduce the rate of dissociation of the natural gas hydrate 82 resulting in a reduced rate of production of natural gas hydrate 82.

Another possible benefit of passing the heating fluid 114 through a fully enclosed well 102 is that the heating fluid 114 does not need to be removed from the natural gas hydrate reservoir 80 during production of the natural gas hydrate 82. If the heating fluid 114 were alternatively injected into the natural gas hydrate reservoir 80, the heating fluid 114 may intermix with the natural gas hydrate 82 water requiring the production of not only the desired natural gas hydrate 82 water, but also the heating fluid 114, greatly increasing the volume of fluid to be removed from the natural gas hydrate reservoir 80.

Another possible benefit of passing the heating fluid 114 through a fully enclosed well 102 is that the waste of the heating system 100 is merely the heating fluid 114. In other words, the heating fluid 114 is not contaminated with other constituents from the natural gas hydrate reservoir 80 or other constituents of the portion of the earth in which the well 102 is formed. In an example embodiment in which the heating fluid 114 is sea water 56, for example, because the heating fluid 114 is not contaminated, the heating fluid 114 can be returned directly to the sea without further processing.

In some embodiments, the wellbore is non-perforated. A typical well includes perforations that enable fluid to flow between the well and an underground reservoir. In some embodiments according to the present disclosure, however, the well 102 is non-perforated to prevent the communication of heating fluid 114 into the natural gas hydrate reservoir 80, and to prevent the communication of natural gas hydrate 82, or other constituents of the portion of the earth 50 into the heating fluid 114.

Figure 3:
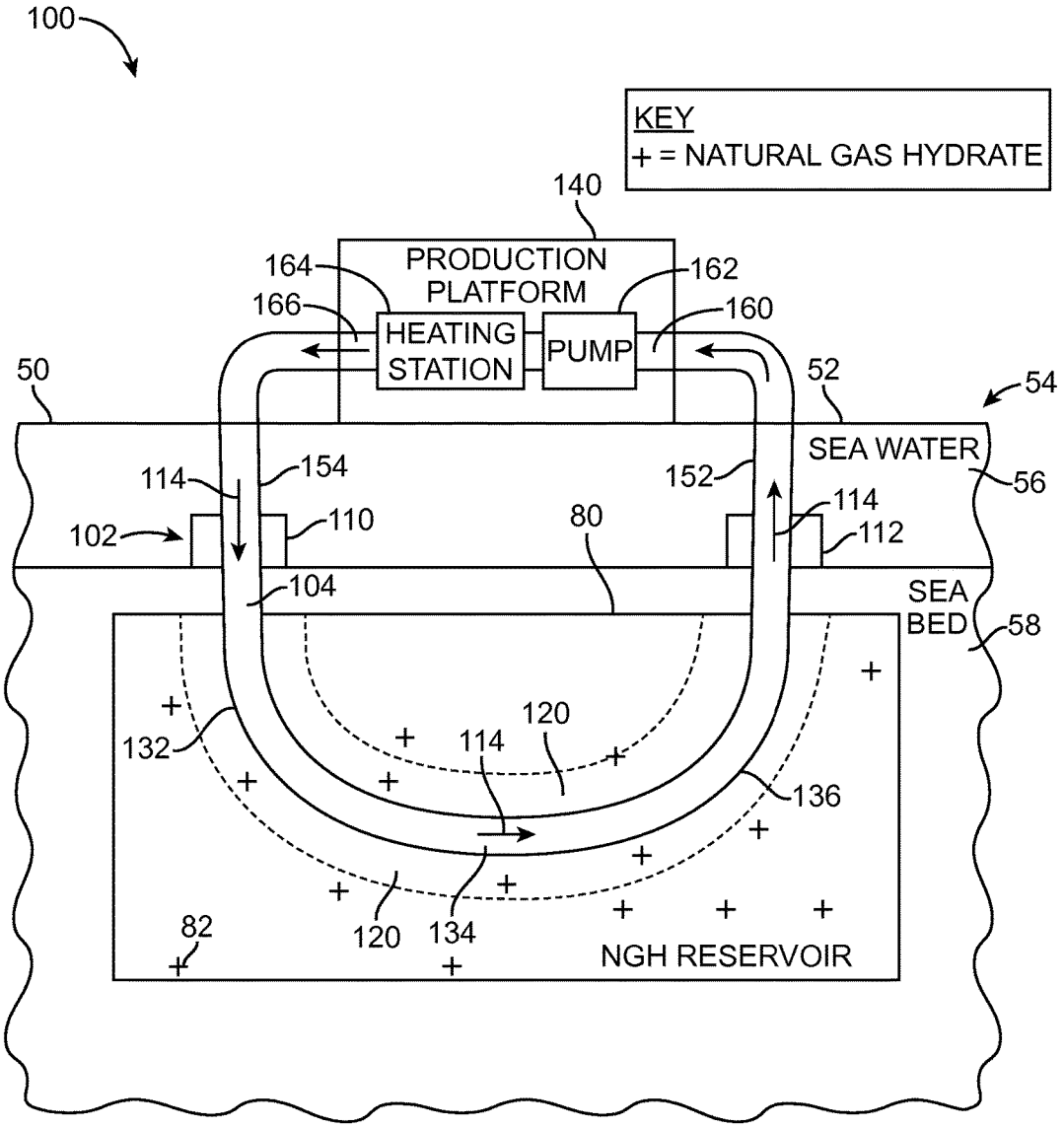
FIG. 3 is a schematic diagram illustrating another example of the heating system shown in FIG. 1.

FIG. 3 is a schematic diagram illustrating another example of a heating system 100 for heating the natural gas hydrate reservoir 80. More specifically, FIG. 3 illustrates an example of a closed loop heating system 100.

In this example, the portion of the earth 50 is the same as illustrated and described with reference to FIG. 2, including sea water 56 and sea bed 58, where the sea bed 58 includes the natural gas hydrate reservoir 80.

A well 102 extends between well heads 110 and 112 in the sea bed 58 and through the natural gas hydrate reservoir. The well 102 can include, for example, a vertical segment 132, a horizontal segment 134, and a slanted segment 136.

The well 102 is connected to a production platform 140 by conduits 152 and 154. For example, the conduit 152 extends from the well head 112 to the production platform 140, and the conduit 154 extends from the well head 110 to the production platform 140.

In this example, the production platform includes an inlet 160, a pump 162, a heating station 164, and an outlet 166. In some embodiments the conduit 152 is coupled to the inlet 160 and the conduit 154 is coupled to the outlet.

In some embodiments, the heating system 100 forms a closed loop through which the heating fluid 114 passes. As one example, the heating fluid 114 may initially be sea water 56 drawn from the sea by the pump 162. The heating fluid 114 passes through the conduit 154 and into the well 102 through the well head 110. The heating fluid then passes through the wellbore 104, such as through the vertical, horizontal, and slanted segments 132, 134, and 136, and out the well head 112. The heating fluid 114 then flows through the conduit 152 where it returns to the inlet 160 of the production platform 140. The production platform 140 continues pumping the heating fluid 114 to maintain an adequate flow rate. The heating fluid 114 is then output through the outlet 166 where the process is repeated.

In some embodiments the heating fluid 114 is passed through a heating station 164. One example of a heating station 164 includes a heat exchanger. In some embodiments, the heating station 164 utilizes warmer sea water 56 to warm the heating fluid 114 to a temperature greater than the temperature of the natural gas hydrate reservoir 80, before cycling the heating fluid 114 through the well 102.

In another possible embodiment, the heating station 164 utilizes the heating fluid 114 as a coolant for other equipment on the production platform 140. When the heating fluid 114 is used as a coolant in the production platform 140 equipment, the equipment heats the heating fluid 114. The heated heating fluid 114 is then passed through the well 102 where it heats the natural gas hydrate reservoir 80.

Figure 4:
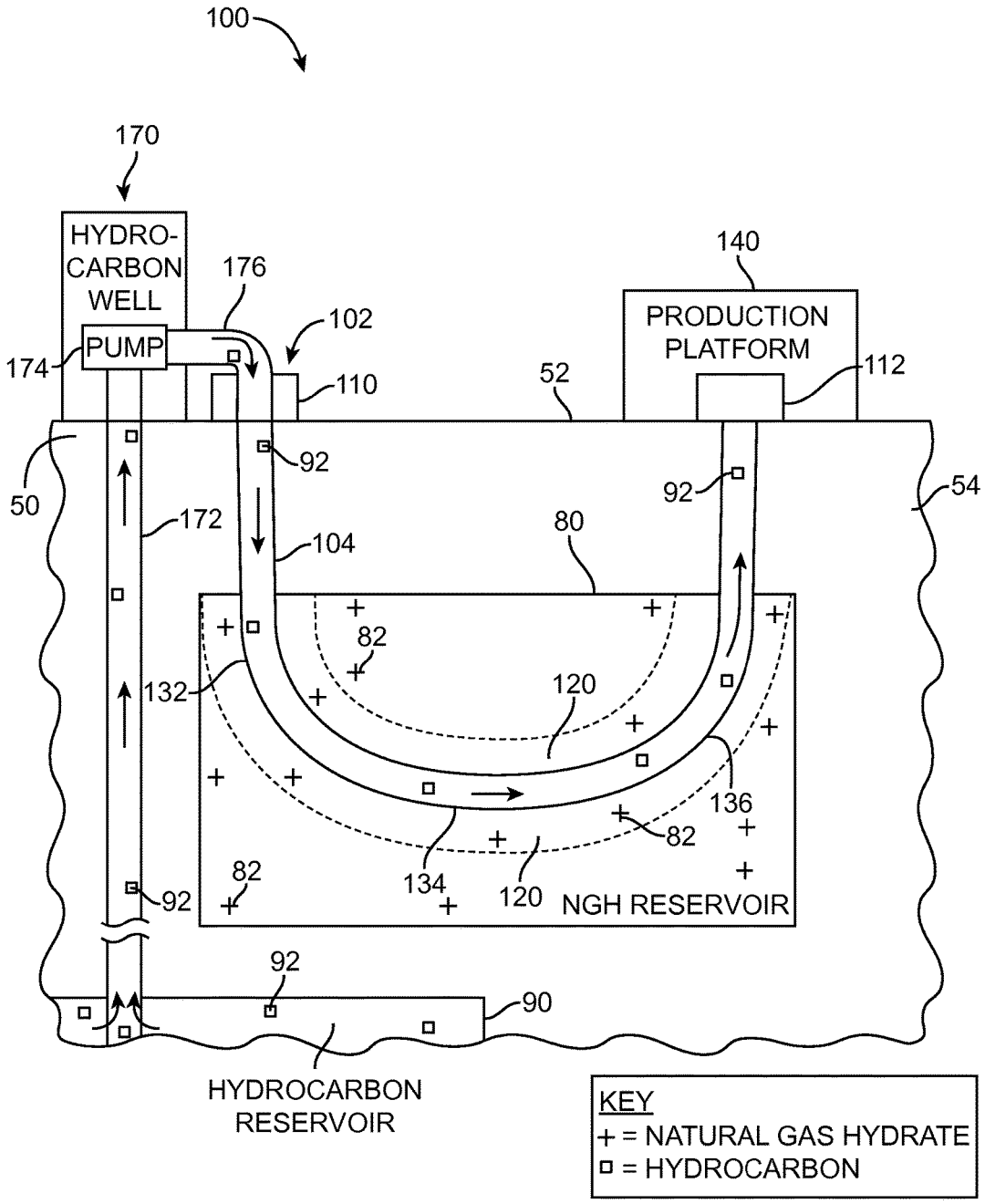
FIG. 4 is a schematic diagram illustrating another example of the heating system shown in FIG. 1.

FIG. 4 is a schematic diagram illustrating another example of a heating system 100 for heating a natural gas hydrate reservoir 80. In this example, the heating system 100 includes a hydrocarbon well 170 that produces hydrocarbon. The hydrocarbon is then used as the heating fluid 114 of the heating system 100.

In this example, the portion of the earth 50 includes a surface 52 and subsurface portion 54. The subsurface portion 54 includes a natural gas hydrate reservoir 80 containing natural gas hydrate 82, and also includes a hydrocarbon reservoir 90 including hydrocarbon 92.

The hydrocarbon well 170 includes a wellbore 172 that extends into a hydrocarbon reservoir 90. One example of the hydrocarbon 92 contained in the well is crude oil. Other forms of hydrocarbon 92 are found in other hydrocarbon wells 90.

The hydrocarbon well 170 operates to extract the hydrocarbon 92 from the hydrocarbon reservoir 90. In some embodiments, the temperature of the hydrocarbon 92 in the hydrocarbon reservoir 90 is naturally greater than the temperature of the natural gas hydrate reservoir 80. In other embodiments, enhanced oil recovery techniques are used which involve heating the hydrocarbons prior to production. One example of an enhanced oil recovery technique involves steam heating, in which steam is injected into the hydrocarbon reservoir 90 to heat the hydrocarbons 92, reduce viscosity, and improve production.

A pump 174 operates to draw the hydrocarbon 92 from the hydrocarbon reservoir 90 and through the hydrocarbon well 170. In this example, the hydrocarbon well 170 is connected to the well 102, such as through a conduit 176. The extracted hydrocarbon 92 is then supplied through the conduit 176 and into the well 102 at the well head 110.

The hydrocarbon 92 flows through the well 102, such as through the vertical, horizontal, and slanted portions of the wellbore 104. While flowing through the well 102, heat is transferred from the hydrocarbon 92 into the natural gas hydrate reservoir 80, forming a heated portion 120. The hydrocarbon 92 then exits the well 102 at well head 112, and is delivered to a production platform 140, for example.

Figure 5:
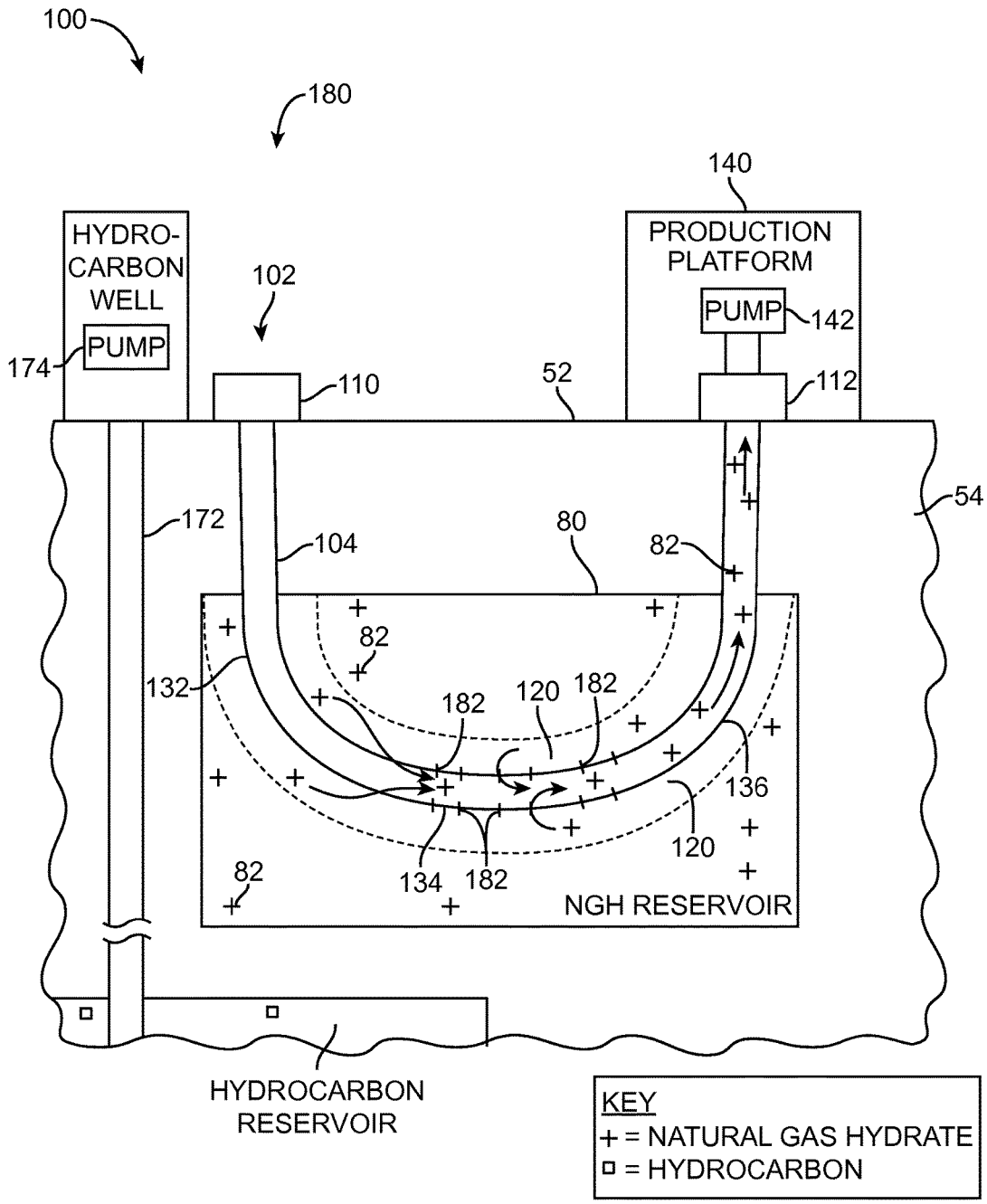
FIG. 5 is a schematic diagram illustrating the conversion of the example heating system shown in FIG. 4 into a production system for extracting natural gas hydrate water from the natural gas hydrate reservoir.

FIG. 5 is a schematic diagram of the heating system 100, further illustrating how the heating system 100 can be converted into a production system 180 for extracting the natural gas hydrate 82 water from the natural gas hydrate reservoir 80. The production system 180 utilizes the same well 102 that was used for heating the natural gas hydrate reservoir 80 to extract the natural gas hydrate 82 water.

In this example, the well 102 is disconnected from the hydrocarbon well by removing the conduit 176 from the well head 110. In some embodiments the well 102 is cleaned to remove excess hydrocarbon 92.

In some embodiments, after heating the natural gas hydrate reservoir 80 to form the heated portion 120, the well 102 is perforated with apertures 182. The apertures permit the natural gas hydrate 82 to be drawn into the well 102. A pump 142, such as on the production platform 140, operates to draw the natural gas hydrate 82 water out of the natural gas hydrate reservoir 80 and into the wellbore 104. The well head 110 is closed in some embodiments to permit the pump 142 to apply adequate suction to the well 102 to draw the natural gas hydrate 82 water into the well 102 through the apertures 182. The natural gas hydrate 82 water continues through the well bore and out through the well head 112. In another possible embodiment, the natural gas hydrate 82 can alternatively be drawn out through the well head 112. In a further embodiment, two pumps are used, each connected at opposite ends of the wellbore 104 (e.g., to well head 110 and well head 112) to draw the natural gas hydrate 82 water out from both ends of the well 102.

The perforation of the well 102 and production of natural gas hydrate can similarly be performed with any of the example embodiments described herein, such as in the examples shown in FIG. 1, 2, 3, or 4.

Figure 6:
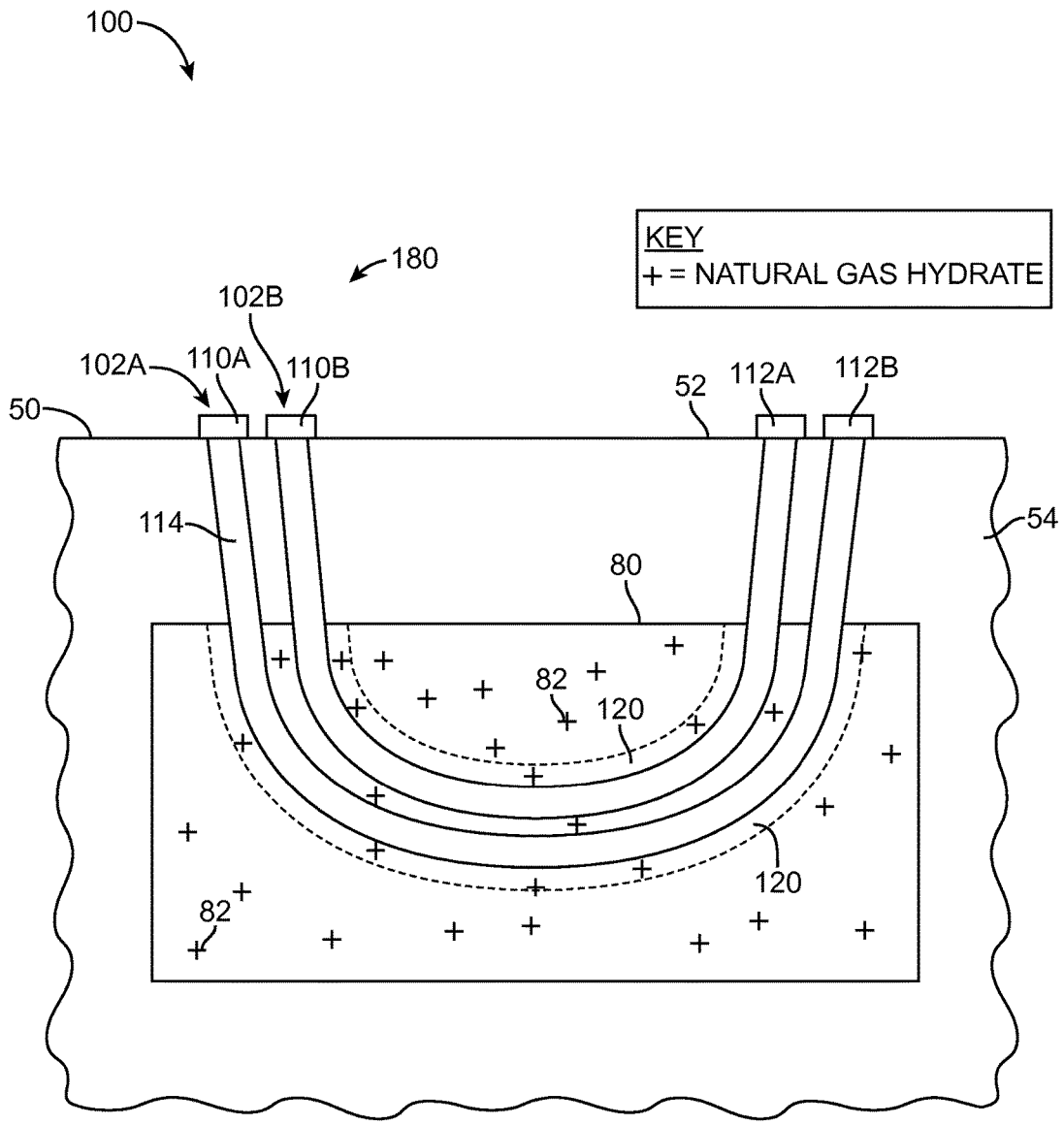
FIG. 6 is a schematic diagram illustrating another example embodiment of the heating system shown in FIG. 1.

FIG. 6 is a schematic diagram illustrating another example embodiment of a heating system 100 including multiple wells 102A and 102B.

In order to heat a larger portion of the natural gas hydrate reservoir 80, this example of the heating system 100 includes two or more adjacent wells 102A and 102B. A heating fluid 114 is supplied through the wells 102A and 102B (according to any of the example embodiments described herein), which heats the natural gas hydrate reservoir adjacent to the wells 102A and 102B generating a larger heated portion 120. The wells 102A and 102B can be arranged vertically adjacent to each other, as depicted in FIG. 6, or may be arranged horizontally adjacent to each other.

Once heating has been completed, one or all of the wells 102A and 102B can be perforated and converted into a portion of a production system, as shown in FIG. 5, for example.

In another possible embodiment, one of the wells 102A is used for heating while another of the wells 102B is used for production. In this example, the well 102B is perforated to permit extraction of the natural gas hydrate 82 water. The wells 102A and 102B can be operated simultaneously, for example, to heat the natural gas hydrate reservoir 80 through well 102A at the same time that natural gas hydrate 82 water is being produced from the reservoir 80 through well 102B (or vice versa).

Figure 7:
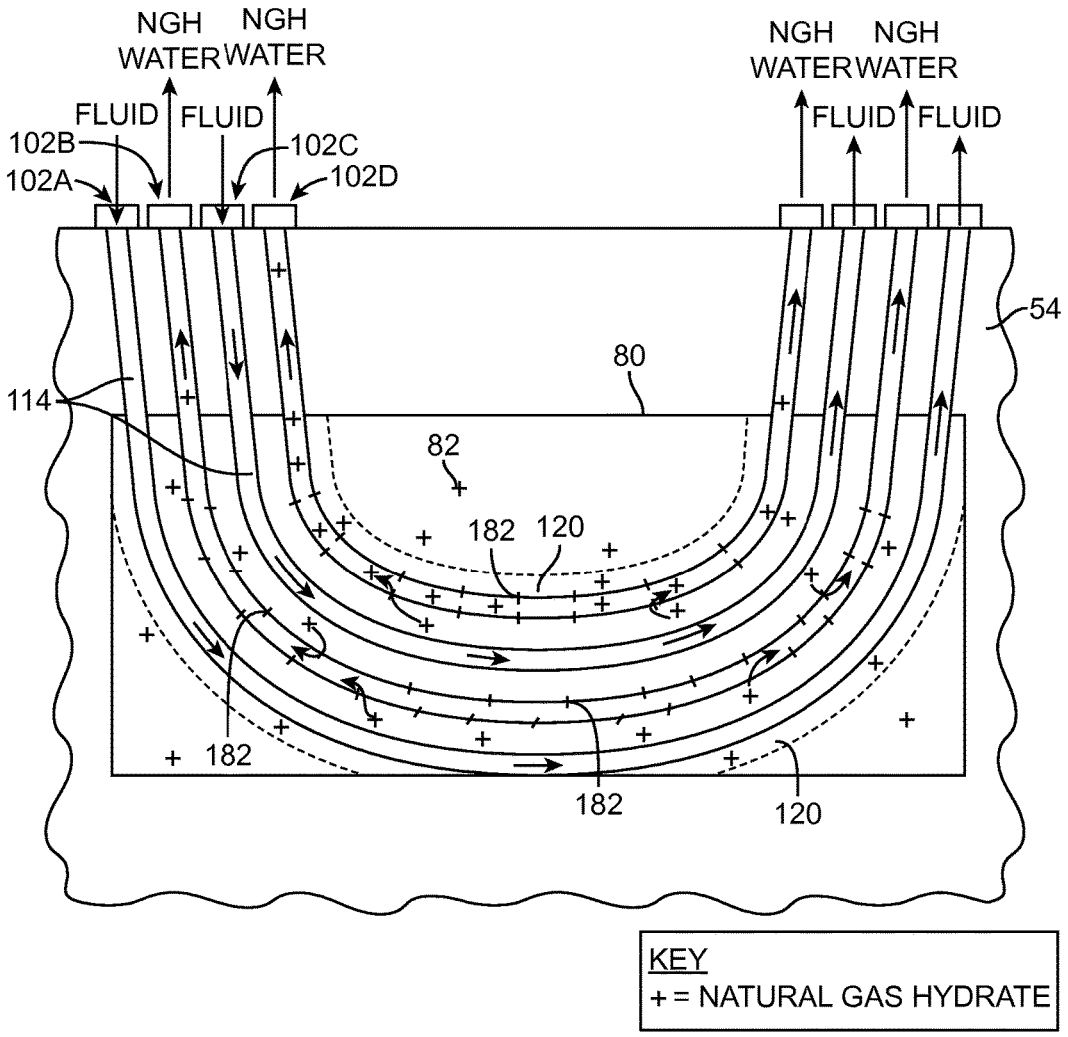
FIG. 7 is a schematic diagram illustrating another example of heating and production systems.

FIG. 7 is a schematic diagram illustrating another example of heating and production systems 100 and 180. In this example, the heating and production systems 100 and 180 include an alternating series of wells 102A, 102B, 102C, and 102D.

The heating system 100 includes alternately arranged heating wells 102A and 102C. The heating wells 102A and 102C are fully enclosed and configured to direct a heating fluid 114 into and through the natural gas hydrate reservoir 80, without injecting the heating fluid 114 directly into the natural gas hydrate reservoir 80. Heat is transferred from the heating fluid 114 into the natural gas hydrate reservoir 80 to form a heated portion 120.

The production system 180 includes the other alternately arranged production wells 102B and 102D. The production wells 102B and 102D are perforated with apertures 182 to allow the natural gas hydrate 82 water to be extracted.

Other possible components of the heating and production systems 100 and 180, such as one or more pumps and fluid sources are not illustrated in FIG. 7 for simplicity, but examples of such components are illustrated in FIGS. 2-5 herein.

Although aspects of the present disclosure are described in terms of an example embodiment involving a natural gas hydrate reservoir, the same or similar concepts may also be applied to other types of reservoirs containing other natural resources.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A method of heating natural gas hydrate, the method comprising:

forming a fully enclosed non-perforated well extending through a portion of a natural gas hydrate reservoir, the reservoir containing natural gas hydrate; and passing a heating fluid through the fully enclosed non-perforated well to heat the natural gas hydrate in the portion of the natural gas hydrate reservoir without injecting the heating fluid directly into the portion of the natural gas hydrate reservoir.

2. The method of claim 1, wherein a temperature of the heating fluid is greater than a temperature of the natural gas hydrate in the natural gas hydrate reservoir.

3. The method of claim 2, wherein the temperature of the heating fluid is an initial temperature of the heating fluid before the heating fluid passes through the portion of the natural gas hydrate reservoir.

4. The method of claim 1, wherein the well includes first and second ends, and wherein the first end of the well is coupled to a first wellhead and wherein the second end of the well is coupled to a second wellhead.

5. The method of claim 4, wherein after the well is filled with the fluid, a volume of the fluid entering the first end of the well is substantially equal to a volume of the fluid exiting the second end of the well.

6. The method of claim 4, wherein the first and second ends are located above the natural gas hydrate reservoir.

7. The method of claim 1, wherein after the fluid has passed through the well, the fluid is free of natural gas hydrate water from the natural gas hydrate reservoir.

8. The method of claim 1, wherein the heating fluid is sea water extracted from a body of water.

9. The method of claim 8, further comprising:

after passing the sea water through the well, returning the sea water to the body of water.

10. The method of claim 1, wherein the heating fluid is hydrocarbon supplied from a hydrocarbon well after extraction of the hydrocarbon from a hydrocarbon reservoir.

11. A method of producing natural gas hydrate from a natural gas hydrate reservoir, the method comprising:

heating a portion of the natural gas hydrate reservoir by passing a heating fluid through a fully enclosed non-perforated wellbore extending through the portion of the natural gas hydrate reservoir without injecting the heating fluid directly into the portion of the natural gas hydrate reservoir;

perforating the wellbore after heating the portion of the natural gas hydrate reservoir; and extracting natural gas hydrate water from the natural gas hydrate reservoir through the wellbore.

12. The method of claim 11, further comprising:

heating a second portion of the natural gas hydrate reservoir by passing the heating fluid through a fully enclosed non-perforated second wellbore adjacent the other wellbore without injecting the heating fluid directly into the second portion of the natural gas hydrate reservoir;

perforating the second wellbore after heating the second portion of the natural gas hydrate reservoir; and extracting natural gas hydrate water from the natural gas hydrate reservoir through the second wellbore.

13. The method of claim 11, wherein the wellbore includes a first end that is located above the natural gas hydrate reservoir and a second end that is located above the natural gas hydrate reservoir.

14. The method of claim 13, wherein the first end that is located above the natural gas hydrate reservoir is coupled to a first wellhead and wherein the second end that is located above the natural gas hydrate reservoir is coupled to a second wellhead.

15. The method of claim 11, wherein the wellbore is U-shaped.

16. The method of claim 11, wherein the wellbore comprises a vertical segment, a horizontal segment, and a slanted segment, wherein the horizontal segment is arranged between and connected to the vertical segment and to the slanted segment.

17. The method of claim 11, wherein after the heating fluid has passed through the fully enclosed non-perforated wellbore, the heating fluid is free of natural gas hydrate water from the natural gas hydrate reservoir.

18. The method of claim 11, wherein the heating fluid is sea water extracted from a body of water.

19. The method of claim 18, further comprising:

after passing the sea water through the fully enclosed non-perforated wellbore, returning the sea water to the body of water.

20. The method of claim 11, wherein the heating fluid is hydrocarbon supplied from a hydrocarbon well after extraction of the hydrocarbon from a hydrocarbon reservoir.

21. A fully enclosed non-perforated wellbore extending through a portion of a natural gas hydrate reservoir with a heating fluid therein, wherein the heating fluid passes through the fully enclosed non-perforated wellbore to heat natural gas hydrate in the portion of the natural gas hydrate reservoir without injecting the heating fluid directly into the portion of the natural gas hydrate reservoir.

22. The wellbore of claim 21, wherein the wellbore is a horizontal wellbore.

23. The wellbore of claim 21, wherein the wellbore is U-shaped.

24. The wellbore of claim 23, comprising a vertical segment, a horizontal segment, and a slanted segment, wherein the horizontal segment is arranged between and connected to the vertical segment and to the slanted segment.

25. The wellbore of claim 21, wherein the wellbore includes a first end that is located above the natural gas hydrate reservoir and a second end that is located above the natural gas hydrate reservoir.

26. The wellbore of claim 25, wherein the first end that is located above the natural gas hydrate reservoir is coupled to a first wellhead and wherein the second end that is located above the natural gas hydrate reservoir is coupled to a second wellhead.

27. The wellbore of claim 21, and wherein a second perforated wellbore is utilized to extract natural gas hydrate water from the natural gas hydrate reservoir.

28. A heating system comprising:

a fully enclosed non-perforated wellbore extending through a portion of a natural gas hydrate reservoir, the fully enclosed non-perforated wellbore including a first end and a second end; and a fluid pump configured to pump a heating fluid through the fully enclosed non-perforated wellbore to heat the portion of the natural gas hydrate reservoir without injecting the heating fluid directly into the portion of the natural gas hydrate reservoir.

29. The heating system of claim 28, wherein the wellbore is coupled to a production platform in a closed loop configuration such that the heating fluid is cycled through the wellbore.

30. The heating system of claim 28, further comprising a heating station, wherein the heating station utilizes the heating fluid as a coolant for production rig equipment to heat the heating fluid before pumping the heating fluid through the wellbore.

31. The heating system of claim 28, wherein the first end is located above the natural gas hydrate reservoir and the second end is located above the natural gas hydrate reservoir.

32. The heating system of claim 28, wherein the first end that is located above the natural gas hydrate reservoir is coupled to a first wellhead and wherein the second end that is located above the natural gas hydrate reservoir is coupled to a second wellhead.

33. The heating system of claim 28, wherein the heating fluid is sea water extracted from a body of water.

34. The heating system of claim 28, wherein the heating fluid is hydrocarbon supplied from a hydrocarbon well after extraction of the hydrocarbon from a hydrocarbon reservoir.

35. The heating system of claim 34, further comprising a conduit, and wherein the wellbore and the hydrocarbon well are connected through the conduit.

* * * * *